US011839787B2

(12) United States Patent
Werner

(10) Patent No.: US 11,839,787 B2
(45) Date of Patent: Dec. 12, 2023

(54) EXERCISING DEVICE FOR STIMULATING DEEP MUSCLES AND METHOD FOR OPERATING THE EXERCISING DEVICE

(71) Applicant: Simon Werner, Borsdorf (DE)

(72) Inventor: Simon Werner, Borsdorf (DE)

( * ) Notice: Subject to any disclaimer, the term of this patent is extended or adjusted under 35 U.S.C. 154(b) by 293 days.

(21) Appl. No.: 17/237,615

(22) Filed: Apr. 22, 2021

(65) Prior Publication Data

US 2021/0331019 A1 Oct. 28, 2021

(30) Foreign Application Priority Data

Apr. 23, 2020 (DE) ..... 20 2020 001 713

(51) Int. Cl.

| | |
|---|---|
| ***A63B 21/00*** | (2006.01) |
| ***A63B 21/055*** | (2006.01) |
| ***A63B 21/06*** | (2006.01) |
| ***A63B 21/04*** | (2006.01) |

(52) U.S. Cl.

CPC .. *A63B 21/00196* (2013.01); *A63B 21/00069* (2013.01); *A63B 21/0414* (2013.01); *A63B 21/0557* (2013.01); *A63B 21/0602* (2013.01); *A63B 21/0552* (2013.01); *A63B 2220/64* (2013.01); *A63B 2244/04* (2013.01)

(58) Field of Classification Search

CPC ... A63B 21/0724–0726; A63B 21/0602–0603; A63B 15/00; A63B 21/00196; A63B 2244/04; A63B 21/0552; A63B 21/0557; A63B 21/0414; A63B 60/002; A63B 21/0004; A63B 21/4039; A63B 21/00069; A63B 21/008; A63B 21/0603; A63B 23/12; A63B 2220/64

See application file for complete search history.

(56) References Cited

U.S. PATENT DOCUMENTS

| | | | | |
|---|---|---|---|---|
| 3,756,592 A * | 9/1973 | Johnson | ..... | A63B 21/0608 482/110 |
| 5,704,856 A * | 1/1998 | Morse | ..... | A63B 69/0002 473/212 |
| 5,820,531 A * | 10/1998 | Choi | ..... | A63B 21/0603 482/110 |

(Continued)

FOREIGN PATENT DOCUMENTS

| | | | | |
|---|---|---|---|---|
| DE | 102009051834 A1 * | 5/2011 | ..... | A63B 21/0603 |
| WO | WO-9409856 A1 * | 5/1994 | ..... | A63B 21/0602 |

(Continued)

*Primary Examiner* — Megan Anderson

(74) *Attorney, Agent, or Firm* — Ewers IP Law PLLC; Falk Ewers

(57) ABSTRACT

An exercising device for fitness training includes a main body forming a container, and a first end and a second end. The main body defines a length between the first end and the second end. The container has an outer surface, an inner surface, and a substantially hollow cylindrical shape with a cross-section which varies between the first end and the second end such that the outer surface and the inner surface define a waveform. A first cover is detachably arranged on the first end and a second cover is detachably arranged on the second end. The container can be filled with a liquid which causes the exercising device to vibrate when it flows through the main body at varying speeds. In addition, a method for operating the exercising device is provided.

18 Claims, 9 Drawing Sheets

(56) References Cited

U.S. PATENT DOCUMENTS

| | | | | |
|---|---|---|---|---|
| 6,312,364 | B1 * | 11/2001 | Selsam | A63B 21/072 482/52 |
| 8,727,951 | B2 * | 5/2014 | Jones | A63B 21/4035 482/109 |
| 8,888,665 | B2 * | 11/2014 | Pfitzer | A63B 21/075 482/109 |
| 11,638,849 | B1 * | 5/2023 | Rimes | A63B 21/0724 482/106 |
| 2010/0144498 | A1 * | 6/2010 | Barber | A63B 21/0602 482/108 |
| 2013/0267390 | A1 * | 10/2013 | Warren | A63B 21/075 482/93 |
| 2018/0117396 | A1 * | 5/2018 | Engelfried, Jr. | A63B 23/0405 |
| 2019/0201733 | A1 * | 7/2019 | Marsh | A63B 21/4001 |

FOREIGN PATENT DOCUMENTS

| | | | | |
|---|---|---|---|---|
| WO | WO-2018157003 | A1 * | 8/2018 | A63B 15/005 |
| WO | WO-2019074533 | A1 * | 4/2019 | A63B 21/0004 |

* cited by examiner

EXERCISING DEVICE FOR STIMULATING DEEP MUSCLES AND METHOD FOR OPERATING THE EXERCISING DEVICE

CROSS REFERENCE TO RELATED APPLICATIONS

This application claims priority to German utility model DE 20 2020 001 713, filed Apr. 23, 2020, the entire content of which is incorporated herein by reference.

TECHNICAL FIELD

The disclosure relates to an exercising device for fitness training, a method for operating the exercising device, and in particular to an exercising device for stimulating deep muscles.

BACKGROUND

Aerobic training or workouts to strengthen the heart and lungs as part of physical therapies have been known for some time. These training methods brought to life a fitness boom that revolutionized therapy and fitness in general. In addition, it has been determined that group sport is much more motivating, and the fun of exercising in a group appears to be of significant relevance. This makes it easier to reach personal limits of exertion, because the group motivation makes the load seem less heavy.

While fitness training can generally be performed without specific exercising devices, certain goals, such as stimulating certain deep muscles of a person who exercises and adjusting the load to individual needs of the person who exercises, are difficult to achieve.

Thus, there has been a continuing need for an exercising device for stimulating deep muscles which can be provided at a reasonable cost, which is easy to handle, and which provides a great flexibility in adjusting the load to individual needs of the person who exercises.

SUMMARY

It is therefore an object of the present disclosure to provide an exercising device for stimulating deep muscles during a fitness training which permits the load to be adjusted and certain deep muscles and the fasciae to be stimulated during the fitness training.

This object is achieved by an exercising device for fitness training and a method for operating the exercising device as described herein.

The exercising device, which can also be described as a fitness bar, can be permanently utilized in a fitness course with a fixed choreography. The load specificity was confirmed by a scientific work at the sports faculty of the University of Leipzig. The material of which the main body of the exercising device is made of is polyethylene in bright light green, but is not limited thereto. According to another exemplary embodiment, the exercising device can also be made of ARBOBLEND®. ARBOBLEND® is made of a plurality of materials including biopolymers such as polyhydroxyalkanoates (PHA), polycaprolactone (PCL), polyester (e.g., bio-PET), starch, polylactic acid (PLA), bio-polyolefins (bio-PE), bio-polyamides (bio-PA), lignin, natural resins, natural waxes, natural oils, natural fatty acids, cellulose, organic additives and natural reinforcing fibers. The two end caps are made of a gray soft rubber material and the filling cap and the tool to mount the filling cap are made of gray hard plastic. The opening is sealed with a rubber seal ring.

Specifically, the exercising device for fitness training includes a main body which forms a container. The main body includes a first end and a second end and has a length defined between the first end and the second end. The length can be, e.g., 1.10 meters. The container has an outer surface, an inner surface, and a substantially hollow cylindrical shape with a cross-section that varies between the first end and the second end such that the outer surface and the inner surface define a waveform.

A first cover is detachably arranged on the first end and a second cover is detachably arranged on the second end.

The cross-section varies between narrow cross-sections and wide cross-sections. The narrow cross-sections are present three times over the length of the main body, and the wide cross-sections are present four times over the length of the main body. The cross-sections are generally circular, but are not limited thereto. For example, ellipsoid cross-sections are also possible.

According to an aspect of the disclosure, the main body of the exercising device, when viewed from a side, has a curved shape of a bow in the form of a double-S with concave portions formed between the wide cross-sections and convex portions formed between the narrow cross-sections.

According to another aspect of the disclosure, the narrow cross-sections have a first diameter of 4 centimeters and the wide cross-sections have a second diameter of 7 centimeters.

The exercising device further includes at least one threaded cap. The main body has at least one opening at at least one of the first and the second end to permit a liquid to be filled in the container. The opening includes a thread, and the at least one threaded cap is configured to be threaded into the opening to tightly seal the container.

The exercising device further includes at least one seal ring configured to be positioned between the at least one threaded cap and the main body.

According to a further aspect of the disclosure, the weight of the exercising device can be adjusted by adjusting an amount of liquid filled in the container. Typically, the liquid is water but is not limited thereto. Other liquids with specific weights different from water can also be used. According to yet another aspect of the disclosure, instead of liquid, a gel or very finely granulated sand could also be filled into the container of the exercising device. The empty weight of the exercising device is 0.70 kilograms and with maximum water filling the weight is 2.70 kilograms.

The main body defines a first axis which extends through the first end and the second end. When the exercising device is pivoted about a second axis which is transverse to the first axis, the liquid flows through the main body, and the substantially hollow cylindrical shape, with the cross-section that varies between the first end and the second end, causes the liquid to flow through the main body at varying speeds. The cross-section can vary by varying the shape and/or the diameter of the cross-section. This causes a predetermined vibration of the exercising device. The vibration stimulates that deep muscles.

Depending on the choreography of the fitness training, the second axis frequently changes and, in some instances, can be perpendicular to the first axis.

According to yet another aspect of the disclosure, the main body defines a first through hole at a first distance from the first end and a second through hole at a second distance from the second end. According to this aspect of the disclosure, the exercising device further includes a stretchable rubber cord having a first cord end and a second cord end. The first cord end is inserted and locked in the first through hole, and the second cord end is inserted and locked in the second through hole. This permits the exercising device to be used during fitness training to simulate movements of the person who exercises which would be typical when operating a classic bow and arrow. The combination of these movements with the vibrations caused by the liquid flowing through the main body permits additional deep muscles to be stimulated in a certain advantageous manner.

Each of the first cover and the second cover are made of soft rubber. The main body includes cavities at the first and second end. The first and second covers have groves and portions protruding from the inner surface of the covers, and the first and second covers are mounted on the main body by placing the groves and/or the portions protruding from the inner surface into the cavities in the main body.

According to a further aspect of the disclosure, at least one of the cavities is provided in the at least one threaded cap.

The method for operating the exercising device includes providing the exercising device with a main body, the main body forming a container, the main body including a first end and a second end, and having a length defined between the first end and the second end, the container having an outer surface, an inner surface, and a substantially hollow cylindrical shape with a cross-section that varies between the first end and the second end such that the outer surface and the inner surface have a waveform, and detachably arranging a first cover on the first end and a second cover on the second end.

The method further includes varying the cross-section between narrow cross-sections and wide cross-sections, the narrow cross-sections being present three times over the length of the main body, and the wide cross-sections being present four times over the length of the main body.

According to another aspect of the disclosure, the method further includes filling the container with a liquid, defining a first axis which extends through the first end and the second end of the main body, causing, by the substantially hollow cylindrical shape with the cross-section that varies between the first end and the second end, the liquid to flow through the main body at varying speeds thereby causing a predetermined vibration of the exercising device when the exercising device is pivoted about a second axis, and the second axis being transverse to the first axis. As discussed above, instead of filling the container with a liquid, the container can also be filled with a gel or with very finely granulated sand, or any other material, as long as the material filled in the container can flow through the main body when the exercising device is pivoted. It goes without saying that materials other than water may create vibrations with different frequencies and with different amplitudes than water.

According to yet another aspect of the disclosure, the method includes defining, by the main body, a first through hole at a first distance from the first end and a second through hole at a second distance from the second end, providing the exercising device with a stretchable rubber cord having a first cord end and a second cord end, inserting and locking the first cord end in the first through hole, and inserting and locking the second cord end in the second through hole.

BRIEF DESCRIPTION OF THE DRAWINGS

The disclosure will now be described with reference to the drawings wherein.

DESCRIPTION OF EXEMPLARY EMBODIMENTS

Exemplary embodiments of the disclosure will be explained below with reference to the accompanying schematic figures. Features that coincide in their nature and/or function may in this case be provided with the same designations throughout the figures.

The terms "exhibit", "have", "comprise" or "include" or any grammatical deviations therefrom are used in a non-exclusive way. Accordingly, these terms can refer either to situations in which, besides the feature introduced by these terms, no further features are present, or to situations in which one or more further features are present. For example, the expression "A exhibits B", "A has B", "A comprises B" or "A includes B" may refer both to the situation in which no further element aside from B is provided in A (that is to say to a situation in which A is composed exclusively of B) and to the situation in which, in addition to B, one or more further elements are provided in A, for example element C, elements C and D, or even further elements.

Furthermore, the terms "at least one" and "one or more" and grammatical modifications of these terms or similar terms, if they are used in association with one or more elements or features and are intended to express the fact that the element or feature can be provided singly or multiply, in general are used only once, for example when the feature or element is introduced for the first time. When the feature or element is subsequently mentioned again, the corresponding term "at least one" or "one or more" is generally no longer used, without restriction of the possibility that the feature or element can be provided singly or multiply.

Also, the terms "preferably", "in particular", "by way of example" or similar terms are used in conjunction with optional features, without alternative embodiments thereby being restricted. In this regard, features introduced by these terms are optional features, and there is no intention to restrict the scope of protection of the claims, and in particular of the independent claims, by these features. In this regard, the disclosure, as will be recognized by a person of ordinary skill in the art, can also be carried out using other configurations. Similarly, features introduced by "in one embodiment of the disclosure" or "in one exemplary embodiment of the disclosure" are to be understood to be optional features, without this being intended to restrict alternative refinements or the scope of protection of the independent claims. Furthermore, all possibilities of combining the features introduced by these introductory expressions with other features, whether optional or non-optional features, are intended to remain unaffected by said introductory expressions.

Figure 1:
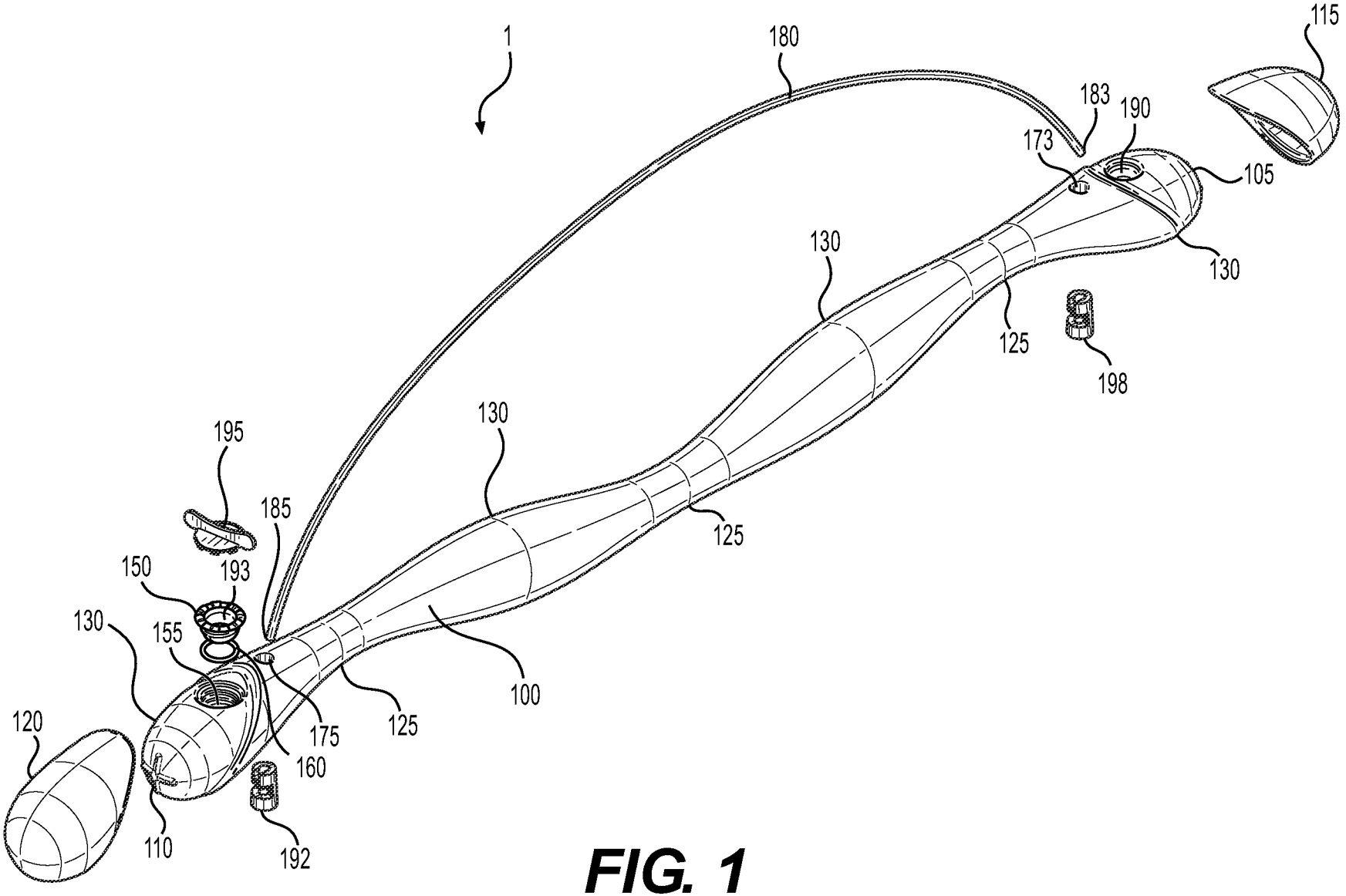
FIG. 1 shows a schematic exploded perspective view of the exercising device according to an exemplary embodiment of the disclosure.
Figure 2:
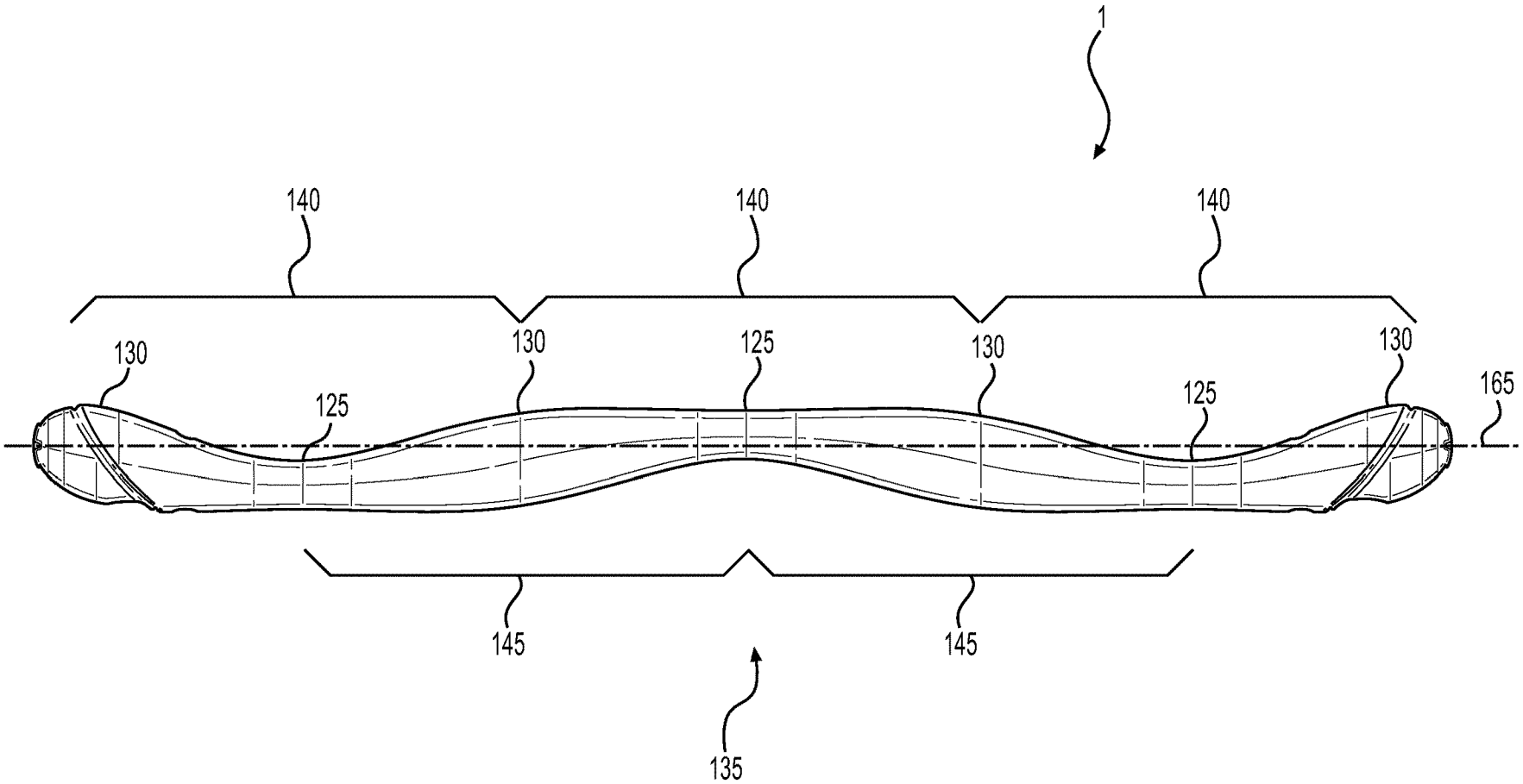
FIG. 2 shows another a side view of the exercising device having a curved shape of a bow.

FIG. 1 shows an exploded perspective view and FIG. 2 shows a side view of an exercising device 1 according to an exemplary embodiment of the disclosure. The exercising device 1 includes a main body 100. The main body 100 forms a container and has a first end 105, a second end 110, and a length defined between the first end 105 and the second end 110. The container has an outer surface, an inner surface (not shown), and a substantially hollow cylindrical shape with a cross-section that varies between the first end 105 and the second end 110 such that the outer surface and the inner surface define a waveform. In addition, the main body 100 of the exercising device 1 defines a first axis 165 which extends through the first end 105 and the second end 110.

As shown in FIG. 1, the cross-section of the substantially hollow cylindrical shape varies between portions of the main body with narrow cross-sections 125 and portions of the main body with wide cross-sections 130. As can be seen in FIG. 1, the narrow cross-sections 125 are present three times over the length of the main body 100, and the wide cross-sections 130 are present four times over the length of the main body 100.

FIG. 2 shows another a side view of the exercising device 1. As can be seen in FIG. 2, when viewed from a side, the main body 100 of the exercising device 1 has a curved shape of a bow 135 with concave portions 140 formed between the wide cross-sections 130 and convex portions 145 formed between the narrow cross-sections 125.

According to an exemplary embodiment of the disclosure, the narrow cross-sections 125 have a first diameter of 4 centimeters and the wide cross-sections 130 have a second diameter of 7 centimeters. However, the disclosure is not limited to these diameters and other diameters are possible. These diameters of the cross sections are carefully selected to obtain predefined vibrations of the main body when the exercising device 1 is rotated as described in further detail below.

Returning back to FIG. 1, which further shows a threaded cap 150. As shown in FIG. 1, the main body 100 has an opening 155 at the second end 110 to permit a liquid to be filled in the container. It is also possible to provide the opening at the first end 105 (not shown) or to provide two openings, one opening at the first end 105 and another opening on the second end 110.

According to an exemplary embodiment of the disclosure, the diameter of the opening is 2.5 centimeters and the diameter of the threaded cap 150 is 3.8 centimeters.

The opening 155 includes a thread. The threaded cap 150 is configured to be threaded into the opening 155 by a tool 195 to tightly seal the container. To properly seal the container, seal ring 160 may be positioned between the threaded cap 150 and the main body 100.

Not every person who exercises has the same load capacity. Therefore, it is an important aspect of the disclosure to permit characteristics of the exercising device 1 to be adjusted in accordance with the capabilities of the person who exercises. Accordingly, an amount of liquid in the main body 100 of the exercising device 1 can easily be added or removed at any time to adjust the weight of the exercising device 1 to the person's capabilities. The amount of liquid in the main body does also have an impact on the vibrations and ultimately on the stimulation of the deep muscles and fasciae. Therefore, by adjusting the amount of liquid, the vibrations, and thereby the effect on the stimulation of the deep muscles and fasciae are also adjusted.

Typically, the liquid is water, but it is not limited thereto. Other liquids with specific weights different from water can also be used. It is intended that the exercising device 1 appeals to as many senses of the person who exercises as possible. These senses include, but are not limited to, seeing, feeling, and hearing. This is crucial to distract from the athletic stress. Therefore, the material and the structure of the exercising device 1 are selected such that the person who exercises can hear the liquid flowing through the main body 100 while feeling the vibration. For this purpose, the main body 100 of the exercising device 1 is made of an at least partially transparent material which permits the liquid to be observed when it flows through the main body 100. According to another exemplary embodiment of the disclosure, the material can also be non-transparent. The material further permits the sound created by the flow of the liquid to be observed by the person who exercises.

The specific configuration and structure of the exercising device 1 permits the exercising device 1 to be utilized during a fitness training as spear, as paddle, or as bow and arrow. The vibrations cause by the flowing liquid and the weight of the amount of liquid in the main body of the exercising device provides the load in the deep muscles and in the fasciae.

According to an aspect of the disclosure, the material of the main body 100 of the exercising device 1 has a green transparent color and is made of plastic from a renewable raw material which can be 100% recycled or at least 95% recycled.

As shown in FIG. 1, the exercising device 1 further includes a first cover 115 which can be detachably arranged on the first end 105 of the main body and a second cover 120 which can be detachably arranged on the second end 110 of the main body. Each of the first and second covers 115, 120 can be made of a soft rubber material. When the exercising device 1 is operated during a fitness training, for example, it is typically held on the end caps by the person who exercises. The rubber material ensures a sufficient grip. In addition, the first and/or second cover protects the threaded cap 150 from any impact.

Figure 3:
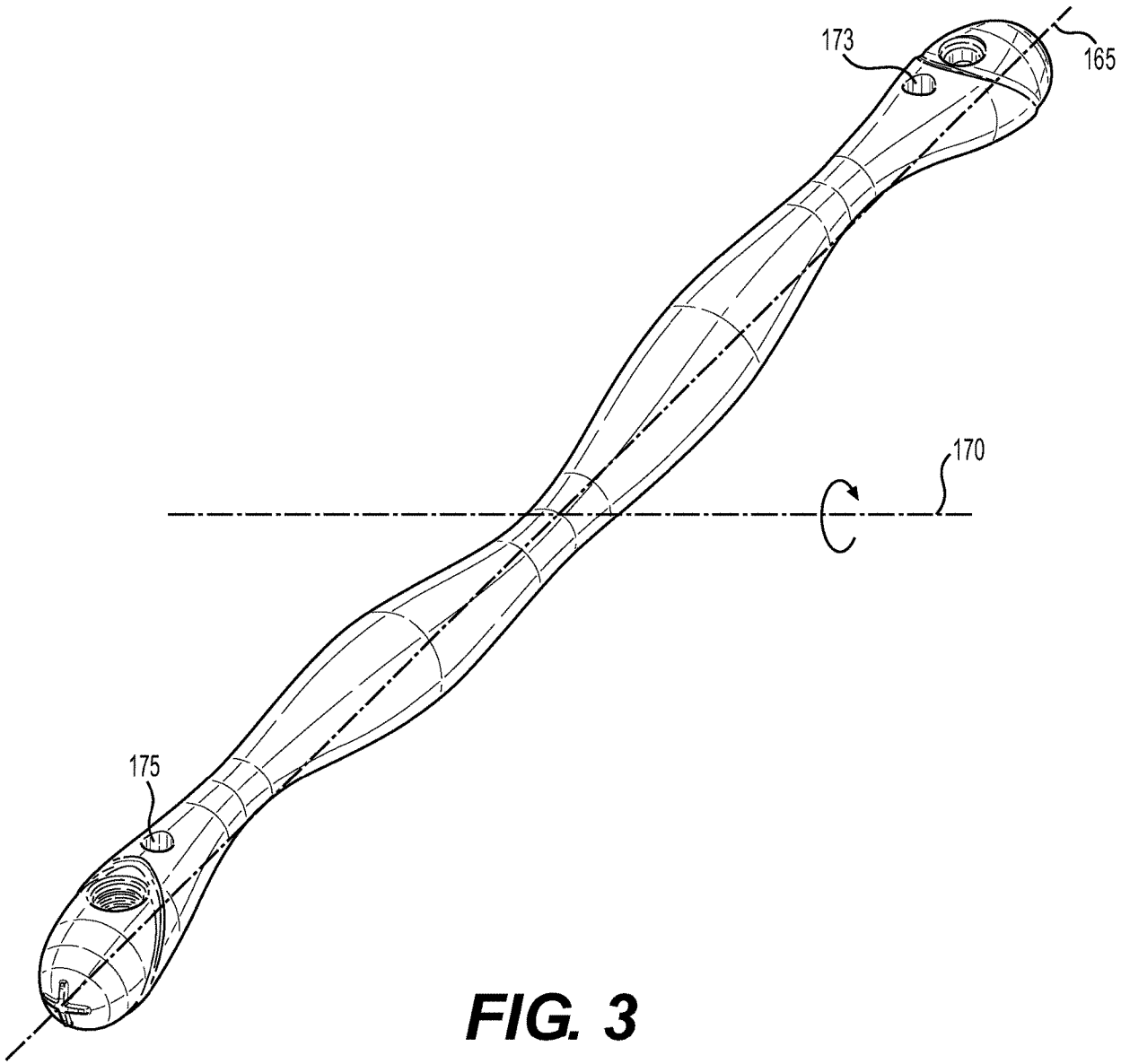
FIG. 3 shows a schematic perspective view of the main body of the exercising device shown in FIG. 1 with an axis of rotation.
Figure 4C:
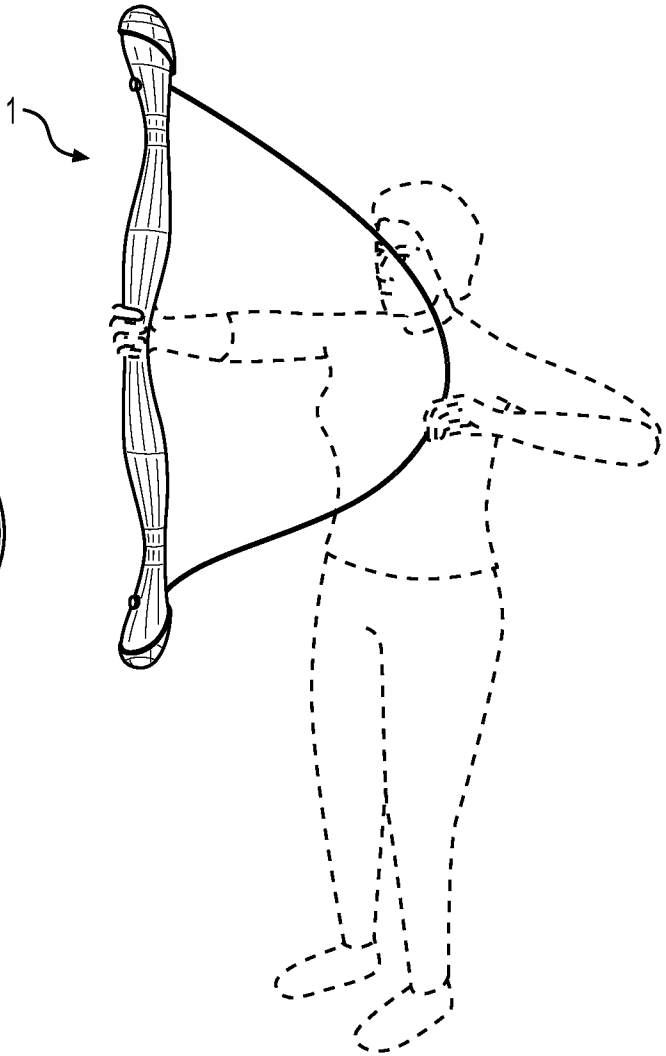
FIG. 4C shows another side view of the exercising device with a stretchable rubber cord in a stretched state held by a person who exercises.
Figure 4B:
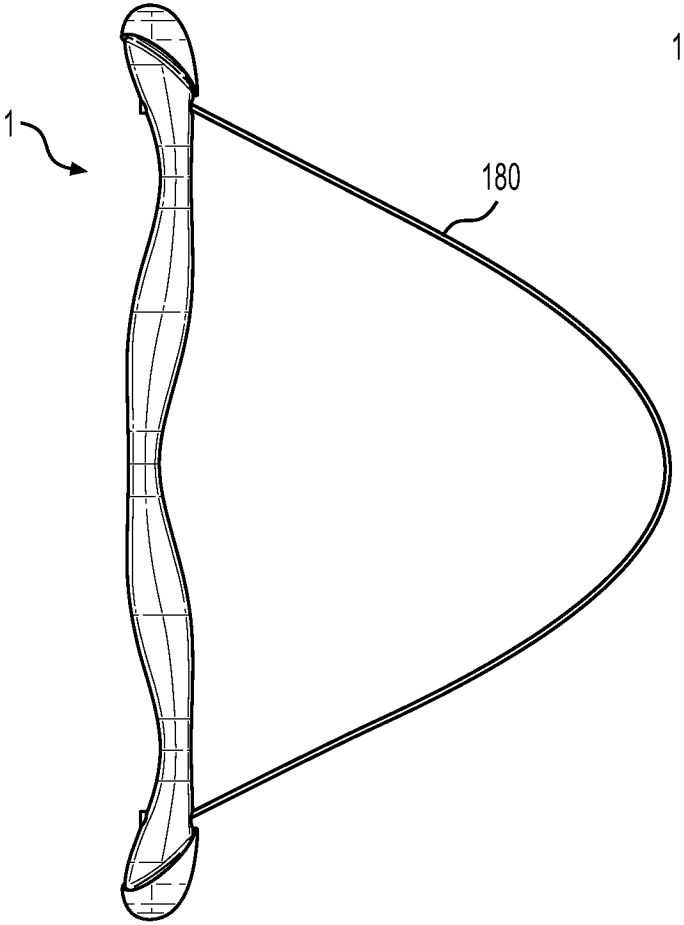
FIG. 4B shows a side view of the exercising device with a stretchable rubber cord in a stretched state.
Figure 4A:
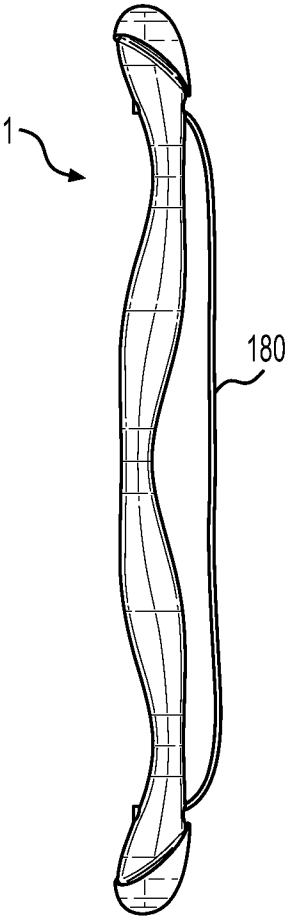
FIG. 4A shows a side view of the exercising device with a stretchable rubber cord in an unstretched state according to another exemplary embodiment of the disclosure.

As shown in FIG. 3, when the exercising device is pivoted about at least a second axis 170 of rotation which is transverse to the first axis 165, the substantially hollow cylindrical shape, with the cross-section that varies between the first end 105 and the second end 110, causes the liquid to flow through the main body 100 at varying speeds which cause a predetermined vibration of the exercising device 1.

Depending on a choreography of the fitness training, the second axis 170 can be at least temporarily perpendicular to the first axis 165 and can frequently vary. Thereby, the vibrations frequently vary and thereby, the deep muscles that are stimulated, vary.

As shown in FIGS. 1 and 3, main body 100 of the exercising device 1 defines a first through hole 173 at a first distance from the first end 105 and a second through hole 175 at a second distance from the second end 110.

As shown in FIGS. 1 and 4A to 4C, the exercising device 1 may further include a stretchable rubber cord 180 with a first cord end 183 and a second cord end 185. The first cord end 183 is inserted and locked in the first through hole 173 with a closure part 198 which is attached to the first cord end 183. The second cord end 185 is inserted and locked with a second closure part 192 in the second through hole 175 with another closure part 192 attached to the second cord end 185. The diameter of each of the through holes 173, 175 for receiving the stretchable rubber cord 180 is 2.00 centimeters on one side and 1.40 centimeters on the opposite side.

Figure 5:
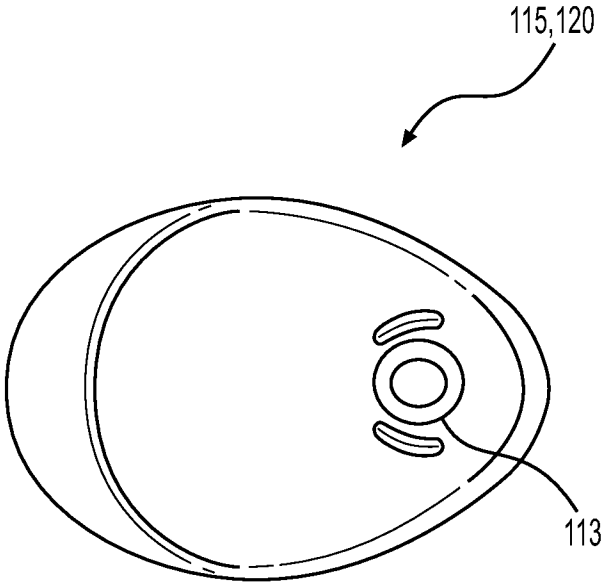
FIG. 5 shows a bottom view of a cover.

According to an aspect of the disclosure, as shown in FIG. 1, the main body 100 includes cavity 190 at the first end 110 and a cavity 193 in the threaded cap 150. As shown in FIG. 5, the first and second end covers 115, 120 include groves 113. The first and second covers 115, 120 are mounted on the main body 100 by placing the groves 113 into the cavities 190, 193 on the main body 100 and in the threaded cap 150, respectively.

Figure 6A:
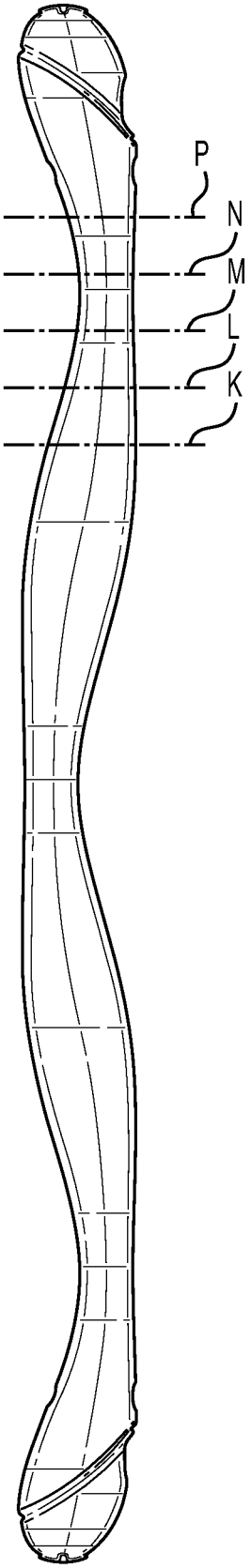
FIG. 6A shows a side view of the exercising device with cross-sections in a concave portion of the main body.
Figure 6B:
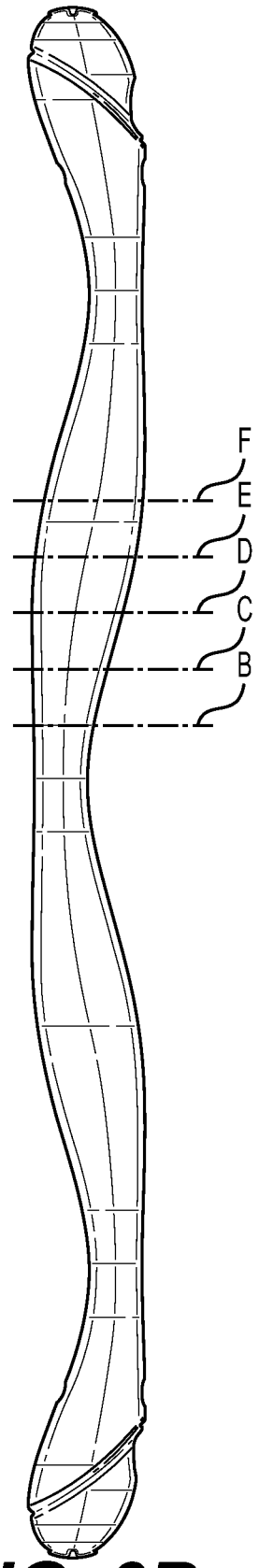
FIG. 6B shows a side view of the exercising device with cross-sections in a convex portion of the main body.
Figure 7A:
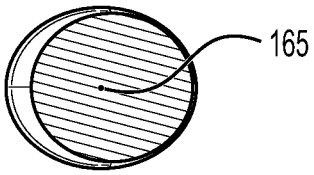
FIGS. 7A to 7E show cross-sections of the concave portion of the main body.
Figure 8A:
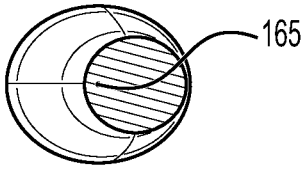
FIGS. 8A to 8E show cross-sections of the convex portion of the main body.
Figure 7B:
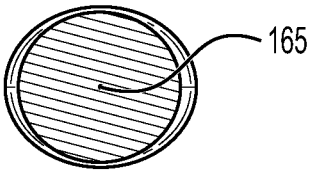
Figure 8B:
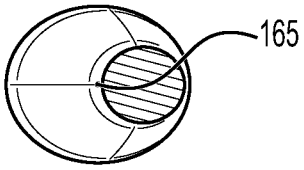
Figure 7C:
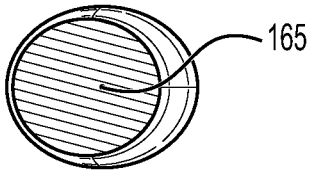
Figure 8C:
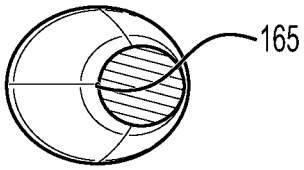
Figure 7D:
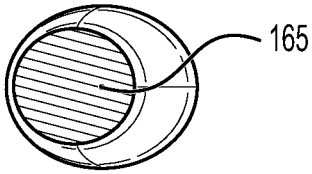
Figure 8D:
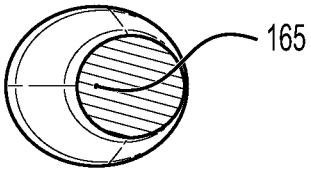
Figure 7E:
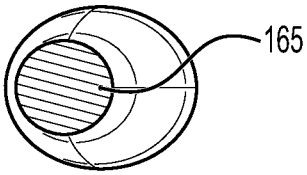
Figure 8E:
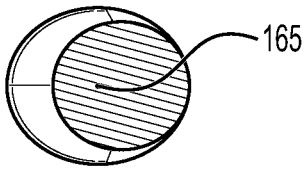

Referring now to FIGS. 6A and 6B in conjunction with FIGS. 7A to 7E and FIGS. 8A to 8E. FIG. 6A shows a side view of the exercising device in which cross-sections P, N, M, L, and K in a concave portion of the main body are indicated. These cross-sections are shown in FIGS. 8A to 8E in which FIG. 8A shows cross-section P, FIG. 8B shows cross-section N, FIG. 8C shows cross-section M, FIG. 8D shows cross-section L, and FIG. 8E shows cross section K.

FIG. 6B shows a side view of the exercising device in which cross-sections F, E, D, C, and B in a convex portion of the main body are indicated. These cross-sections are shown in FIGS. 7A to 7E in which FIG. 7A shows cross-section F, FIG. 7B shows cross-section E, FIG. 7C shows cross-section D, FIG. 7D shows cross-section C, and FIG. 7E shows cross section B.

In addition, FIGS. 7A to 7E and 8A to 8E show the location of first axis 165 relative to the center of each cross section. As can be seen in FIGS. 7A to 7E and 8A to 8E, not only does the diameter of the cross-section vary over the length of the main body 100, the center of the cross-section also varies over the length of the main body relative to the first axis 165.

Figure 9:
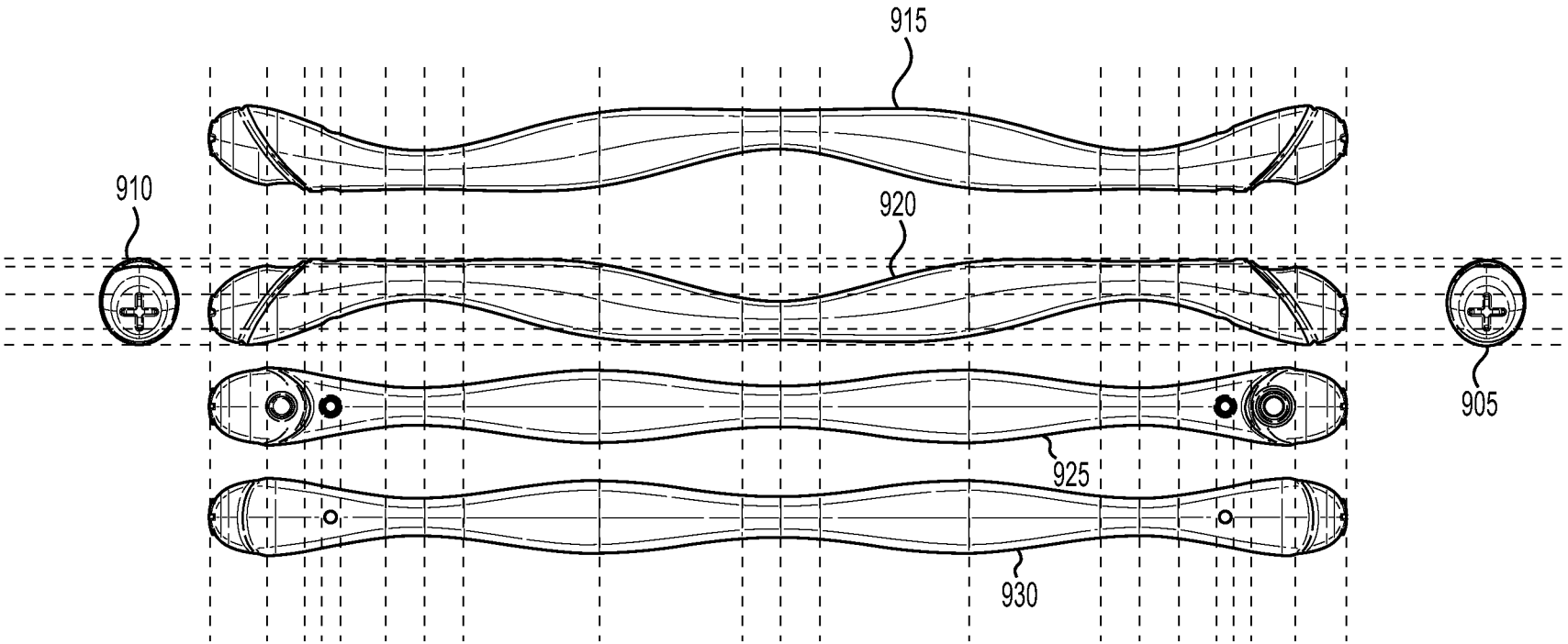
FIG. 9 shows rear, front, top, bottom, and side views of the exercising device according to an exemplary embodiment of the disclosure.

FIG. 9 shows various views of the main body 100 including a front view 905, a rear view 910, a right sight view 915, a left side view 920, a top view 925, and a bottom view 930.

Figure 10:
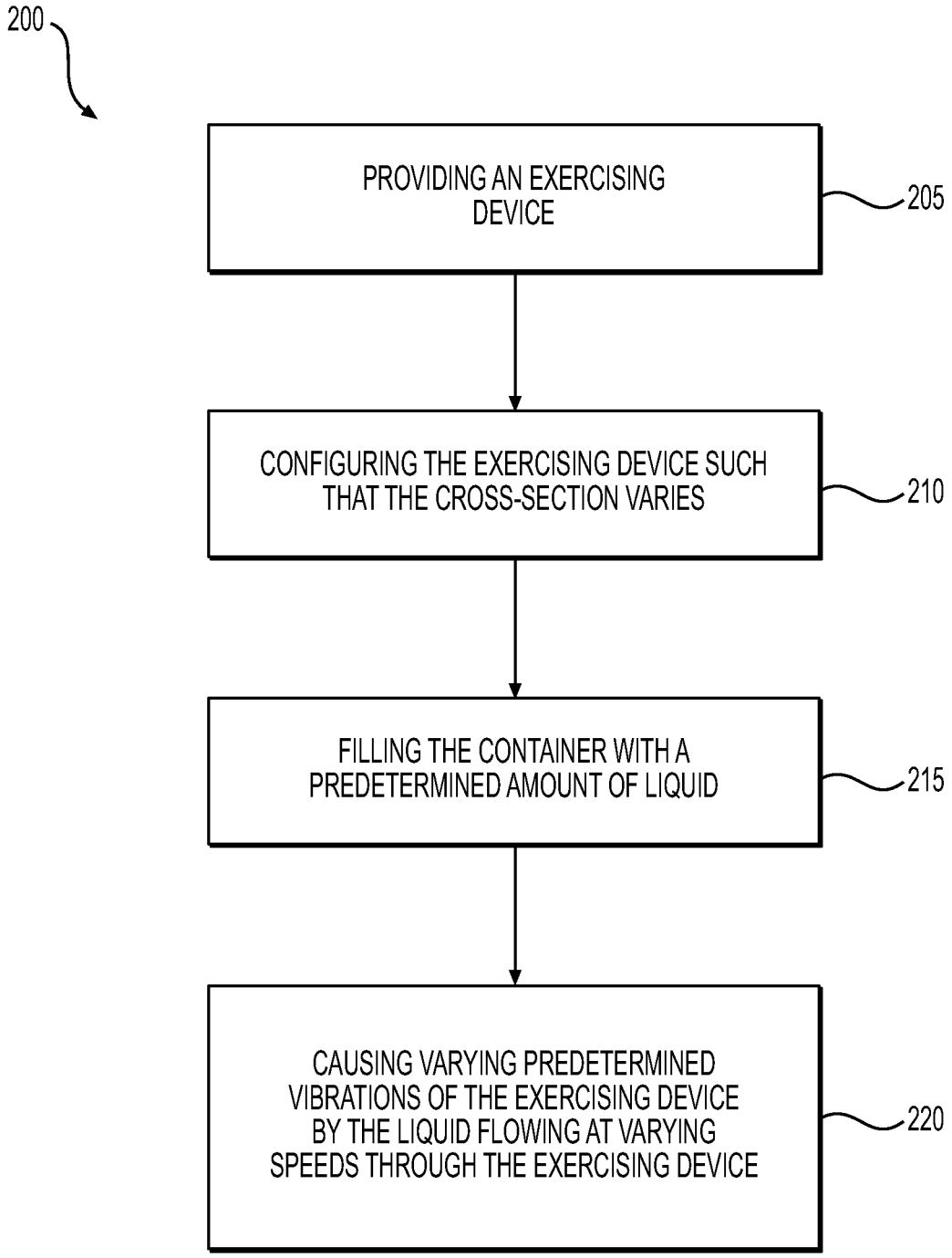
FIG. 10 shows a flow chart of method for operating the exercising device.

Referring now to FIG. 10 (with continued reference to FIG. 1), a flow chart is described of method 200 for operating the exercising device 1. The method 200 starts at step 205. At step 205, the exercising device 1 with a main body 100 is provided. The main body 100 forms a container, includes a first end 105 and a second end 110, and defines a length between the first end 105 and the second end 110. The container has an outer surface, an inner surface, and a substantially hollow cylindrical shape with a cross-section that varies between the first end 105 and the second end 110 such that the outer surface and the inner surface define a waveform.

A first cover 115 on the first end 105 and a second cover 120 on the second end 110 are detachably arranged on the main body 100.

The method 200 continues to step 210 at which the exercising device 1 is configured such that the diameter of the cross-section between narrow cross-sections 125 and wide cross-sections 130 varies, wherein the narrow cross-sections 125 are present three times over the length of the main body 100, and the wide cross-sections 130 are present four times over the length of the main body 100.

At step 215 of the method 200, the container formed by the main body 100 is filled with a predetermined amount of liquid, and step 220, a first axis 165 is defined which extends through the first end 105 and the second end 110 of the main body 100, and the liquid is caused, by the substantially hollow cylindrical shape with the cross-section that varies between the first end 105 and the second end 110, to flow through the main body 100 at varying speeds thereby causing a predetermined vibration of the exercising device when the exercising device is pivoted about a second axis 170, and the second axis 170 being transverse to the first axis 165. According to the method 200, the second axis 170 can also be perpendicular to the first axis 165. In other words, in step 220, varying predetermined vibrations of the exercising device are caused by the liquid flowing at varying speeds through the exercising device thereby stimulating certain deep muscles of the person who exercises with the exercising device.

According to another exemplary embodiment of the disclosure, the method 200 further includes defining, by the main body 100, a first through hole 173 at a first distance from the first end 105 and a second through hole 175 at a second distance from the second end 110, providing the exercising device with a stretchable rubber cord 180 having a first cord end 183 and a second cord end 185, inserting and locking the first cord end 183 in the first through hole 173, and inserting and locking the second cord end 185 in the second through hole 175. This allows combining a stretching movement, performed by the person who exercises, with the vibrations generated by the liquid flowing through the main body 100 of the exercising device 1 at varying speeds. By combining the stretching movement with the vibrations, different deep muscles can be stimulated at the same time.

It is understood that the foregoing description is that of the exemplary embodiments of the disclosure and that various changes and modifications may be made thereto without departing from the spirit and scope of the disclosure as defined in the appended claims.

LIST OF REFERENCE NUMERALS

1 exercising device
100 main body
105 first end of main body
110 second end of main body
115 first cover
120 second cover
125 narrow cross-section
130 wide cross-section
135 curved shape of a bow
140 concave portions
145 convex portions
150 threaded cap
155 opening
160 seal ring
165 first axis
170 second axis
173 first through hole
175 second through hole
180 stretchable rubber cord
183 first cord end
185 second cord end
190 cavity

193 cavity
195 tool
198 closure part

What is claimed is:

1. An exercising device for fitness training, the exercising device comprising:

a main body forming a container, including a first end and a second end, and having a length defined between the first end and the second end;

the container having an outer surface, an inner surface, and a hollow cylindrical shape with a cross-section which varies between the first end and the second end such that the outer surface and the inner surface define a waveform;

a first cover detachably arranged on the first end; and a second cover detachably arranged on the second end, wherein the cross-section varies between narrow cross-sections and wide cross-sections, wherein the narrow cross-sections are present three times over the length of the main body, and wherein the wide cross-sections are present four times over the length of the main body.

2. The exercising device of claim 1, further comprising at least one threaded cap, and wherein:

the main body has at least one opening at at least one of the first and the second end to permit a liquid to be filled in the container, the opening includes a thread, and the at least one threaded cap is configured to be threaded into the opening to tightly seal the container.

3. The exercising device of claim 2, wherein:

the main body defines a first axis which extends through the first end and the second end, the hollow cylindrical shape, with the cross-section that varies between the first end and the second end, causes the liquid to flow through the main body at varying speeds which cause a predetermined vibration of the exercising device when the exercising device is pivoted about a second axis, and the second axis is transverse to the first axis.

4. The exercising device of claim 3, wherein the second axis is perpendicular to the first axis.

5. The exercising device of claim 2, further comprising at least one seal ring configured to be positioned between the at least one threaded cap and the main body.

6. The exercising device of claim 2, wherein a weight of the exercising device is adjusted by adjusting an amount of liquid filled in the container.

7. The exercising device of claim 1, wherein:

each of the first cover and the second cover are made of soft rubber, the main body includes cavities at the first and second end, the first and second covers have portions protruding from inner surfaces of the first and second covers, and the first and second covers are mounted on the main body by placing the portions protruding from the inner surfaces of the first and second covers into the cavities in the main body.

8. The exercising device of claim 7, wherein at least one of the cavities is provided in the at least one threaded cap.

9. The exercising device of claim 1, wherein the main body, when viewed from a side, has a curved shape of a bow with concave portions formed between the wide cross-sections and convex portions formed between the narrow cross-sections.

10. The exercising device of claim 1, wherein the narrow cross-sections have a first diameter of 4 centimeters and the wide cross-sections have a second diameter of 7 centimeters.

11. The exercising device of claim 1, wherein:

the main body defines a first through hole at a first distance from the first end and a second through hole at a second distance from the second end, the exercising device further comprises a stretchable rubber cord having a first cord end and a second cord end, the first cord end is inserted and locked in the first through hole, and the second cord end is inserted and locked in the second through hole.

12. A method for operating the exercising device, the method comprising:

providing the exercising device with a main body, the main body forming a container, the main body including a first end and a second end, and having a length defined between the first end and the second end, the container having an outer surface, an inner surface, and a hollow cylindrical shape with a cross-section which varies between the first end and the second end such that the outer surface and the inner surface define a waveform;

detachably arranging a first cover on the first end and a second cover on the second end; and configuring the exercising device such that the cross-section varies between narrow cross-sections and wide cross-sections, the narrow cross-sections being present three times over the length of the main body, and the wide cross-sections being present four times over the length of the main body.

13. The method of claim 12, further comprising:

filling the container with a liquid;

defining a first axis which extends through the first end and the second end of the main body; and causing, by the hollow cylindrical shape with the cross-section which varies between the first end and the second end, the liquid to flow through the main body at varying speeds thereby causing a predetermined vibration of the exercising device when the exercising device is pivoted about a second axis, and the second axis being transverse to the first axis.

14. The method of claim 13, wherein the second axis is perpendicular to the first axis.

15. The method of claim 12, wherein the main body, when viewed from a side, has a curved shape of a bow with concave portions formed between the wide cross-sections and convex portions formed between the narrow cross-sections.

16. The method of claim 12, wherein the narrow cross-sections have a first diameter of 4 centimeters and the wide cross-sections have a second diameter of 7 centimeters.

17. The method of claim 12, further comprising:

defining, by the main body, a first through hole at a first distance from the first end and a second through hole at a second distance from the second end, providing the exercising device with a stretchable rubber cord having a first cord end and a second cord end;

inserting and locking the first cord end in the first through hole, and inserting and locking the second cord end in the second through hole.

18. An exercising device for fitness training, the exercising device comprising:

a main body forming a container, including a first end and a second end, and having a length defined between the first end and the second end;

the container having an outer surface, an inner surface, and a hollow cylindrical shape with a cross-section which varies between the first end and the second end such that the outer surface and the inner surface define a waveform;

a first cover detachably arranged on the first end; and a second cover detachably arranged on the second end, wherein each of the first cover and the second cover are made of soft rubber, wherein the main body includes cavities at the first and second end, wherein the first and second covers have portions protruding from inner surfaces of the first and second covers, and wherein the first and second covers are mounted on the main body by placing the portions protruding from the inner surfaces of the first and second covers into the cavities in the main body.

* * * * *